US005157371A

United States Patent [19]

Sundquist et al.

[11] Patent Number: 5,157,371

[45] Date of Patent: Oct. 20, 1992

[54] POTENTIOMETER RETENTION MECHANISM AND METHOD OF MOUNTING

[75] Inventors: Arman E. Sundquist, Brooklyn Park; Gerald H. McDonald, Coon Rapids; Donald R. Hagen, Brooklyn Park, all of Minn.

[73] Assignee: Resistance Technology, Inc., Arden Hills, Minn.

[21] Appl. No.: 640,052

[22] Filed: Jan. 11, 1991

[51] Int. Cl.[5] ..... H01C 10/32; H01C 1/02; H04R 25/00

[52] U.S. Cl. ..... 338/162; 338/184; 338/163; 381/68.6; 381/69

[58] Field of Search ..... 338/162, 163, 199, 197, 338/184; 381/77, 220, 221, 68.6, 69

[56] References Cited

U.S. PATENT DOCUMENTS

| | | | |
|---|---|---|---|
| 3,549,828 | 12/1970 | Lang | 179/107 |
| 3,598,928 | 8/1971 | Hickox | 179/107 |
| 4,246,565 | 1/1981 | Wiley et al. | 338/163 |
| 4,329,676 | 5/1982 | McDonald et al. | 338/298 |
| 4,565,990 | 1/1986 | Matsui et al. | 338/162 X |
| 4,598,177 | 7/1986 | McGroarty et al. | 179/107 |
| 4,634,815 | 1/1987 | Marquis | 387/68.4 |
| 4,815,138 | 3/1989 | Diethelm | 381/69.2 |
| 4,835,833 | 6/1989 | McDonald | 29/525 |

*Primary Examiner*—Marvin M. Lateef
*Attorney, Agent, or Firm*—Kinney & Lange

[57] ABSTRACT

A potentiometer retention mechanism is provided for mounting a potentiometer on the faceplate of a hearing aid. The potentiometer includes a rotatable knob attached to a housing with the housing including a plurality of conductive leads projecting from a back surface of the housing. The mechanism includes an adapter for receiving the potentiometer. The adapter has a device for mechanically engaging the faceplate such that the adapter is secured with the faceplate. The mechanism further includes a plurality of angled leads attached to the adapter whereby the potentiometer leads press against the angled leads such that the housing is secured within the adapter.

6 Claims, 1 Drawing Sheet

POTENTIOMETER RETENTION MECHANISM AND METHOD OF MOUNTING

BACKGROUND OF THE INVENTION

The present invention relates to mounting potentiometers, and, in particular, it relates to using an adapter to mount a miniature potentiometer onto a faceplate of a hearing aid.

Great efforts have been made to reduce the size of hearing aids. A primary component of a hearing aid is a potentiometer that is used to control volume. The volume control potentiometer has to be easily accessible to the user. For easy access, the volume control potentiometer is mounted on a faceplate of the hearing aid. In order for the potentiometer to be mounted on the faceplate, the potentiometer has to be quite small, for example, having a diameter of 5/32 inch.

The small size of such potentiometers poses problems in terms of cost and manufacturing efficiency in mounting such potentiometers in hearing aids. Presently, such potentiometers are being adhesively secured within an aperture provided in the faceplate of a hearing aid. Although a satisfactory mount results, adhesive must be given time to cure to a point in which the adhesive starts to hold the potentiometer within the aperture. Prior to such point in time, the mounted potentiometer must be handled carefully in order to avoid dislocation of the potentiometer prior to cure.

An example of a potentiometer mounting mechanism and a method of mounting a potentiometer onto a faceplate is described in McDonald U.S. Pat. No. 4,835,833. The McDonald patent describes a potentiometer mounting mechanism and a method for mounting a potentiometer onto a faceplate which includes a metallic band circumferentially surrounding a portion of the housing of the potentiometer. The band includes a member for engaging a surface of an aperture in the faceplate such that the housing is secured within the aperture. A stop means is also provided that engages a shoulder of the faceplate which positions the potentiometer within the aperture a selected distance such that the knob of the potentiometer extends beyond a front surface of the faceplate.

SUMMARY OF THE INVENTION

The present invention includes a mechanism for mounting a potentiometer, especially a miniature potentiometer onto a faceplate of a hearing aid. The potentiometer includes a rotatable knob attached to a housing. The housing includes a plurality of conductive leads projecting from a back surface of the housing.

The mechanism includes an adapter for receiving the potentiometer. The adapter has a device for mechanically engaging the faceplate such that the adapter is secured within the faceplate. The mechanism further includes a plurality of angled leads attached to the adapter whereby the conductive leads press against the angled leads such that the housing is secured within the adapter.

Preferably, the potentiometer includes an annular shoulder. The potentiometer annular shoulder engages a shoulder surface of the adapter thereby positioning the potentiometer within the aperture a selected distance such that the knob of the potentiometer extends beyond a front surface of the faceplate.

The method of the present invention includes providing an adapter having a device for mechanically engaging a faceplate of the hearing aid and providing a potentiometer having a housing and a plurality of potentiometer leads. Next, the potentiometer is axially inserted in the adapter such that the potentiometer leads press against the angled leads thereby securing the housing within the adapter.

DETAILED DESCRIPTION OF THE PREFERRED EMBODIMENTS

Figure 1:
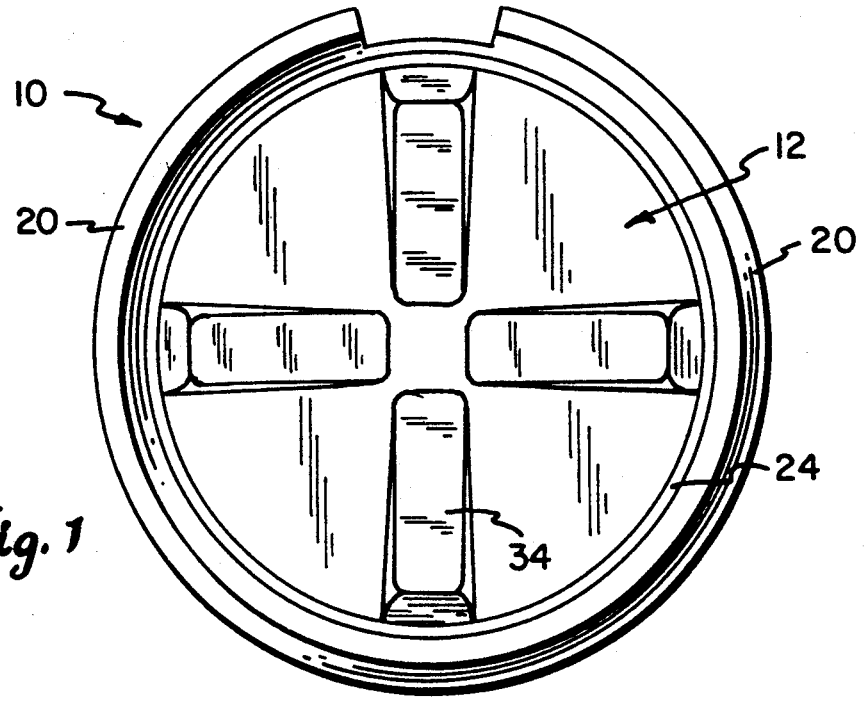
FIG. 1 is a top view of the mechanism for mounting a miniature potentiometer of the present invention.
Figure 2:
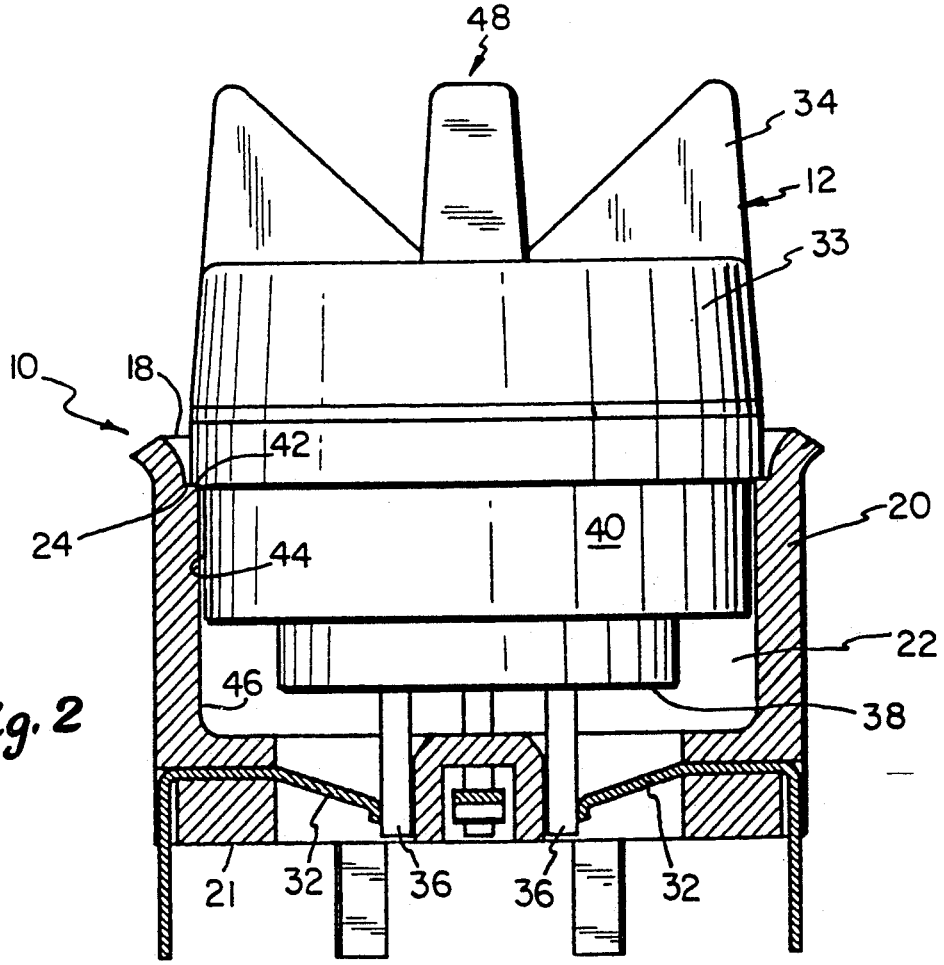
FIG. 2 is a partial sectional view of the mechanism with the adapter and angled leads in crosssection.

The present invention includes a mechanism for mounting a miniature potentiometer, illustrated generally at 10 in FIGS. 1 and 2, onto a faceplate (not shown) of a hearing aid (not shown). A potentiometer 12 is installed as a volume control on the hearing aid. Potentiometers, in general, provide variable electrical resistance between input and output terminals whereby potentiometers are useful in electronic circuits, as for volume control. One example of a miniature potentiometer is described in the Hagen U.S. Pat. No. 4,636,768 assigned to the same assignee as the present application.

The hearing aid used in the present invention is of the variety carried proximate the ear. The faceplate of the hearing aid is designed for mounting a potentiometer 12 thereon.

An adapter 20 for receiving the potentiometer 12 is provided for mounting within the faceplate. The adapter 20 includes a back side 21 and an adapter aperture 22. An inner annular shoulder 24 is provided integral to the adapter 20 and projects into the adapter aperture 22. As discussed later, the potentiometer 12 fits within the adapter aperture 22.

As illustrated in FIG. 2, the adapter 20 further includes a plurality of angled leads 32 extending through the adapter 20 into the adapter aperture 22. In the preferred embodiment, there are five angled leads 32 in the adapter 20. The angled leads 32 are conductive and connected to the hearing aid circuitry (not shown) within the hearing aid. The various elements within the hearing aid are not shown since they are well known in the art.

The potentiometer 12, according to the present invention, includes a rotatable knob 34 rotatably attached to a housing 40. The housing 40 is made of a non-conductive plastic, such as a glass-filled nylon. A plurality of conductive potentiometer leads 36 extend from a bottom or rearward side 38 of the housing 40. In the preferred embodiment, there are five conductive potentiometer leads 36 extending from the housing 40. Various elements within the potentiometer 12 are not shown since they are well known within the art.

As illustrated in FIG. 2, the potentiometer 12 includes a potentiometer annular shoulder 42 for positioning the potentiometer 12 a selected distance within the adapter 20. The diameter measured between an outer surface 44 of the housing 40 is less than the diameter of an inner surface 46 of the adapter aperture 22 of the adapter 20 such that the housing 40 is inserted into the adapter 20.

The inner annular shoulder 24 and the potentiometer annular shoulder 42 act as a stopping mechanism that positions the potentiometer 12 within the adapter 20 a selected distance such that the knob of the potentiometer extends beyond a front surface of the faceplate. The potentiometer annular shoulder 42 extends a distance greater than the diameter of the adapter aperture 22 of the adapter 20 so that the potentiometer annular shoulder 42 engages the inner annular shoulder 24.

The angled leads 32 of the adapter 20 are positioned such that the conductive potentiometer leads 36 press against the angled leads 32 upon insertion of the potentiometer 12 into the adapter 20. The contact between the conductive potentiometer leads 36 and the angled leads 32 secure the potentiometer 12 within the adapter aperture 22 of the adapter 20.

In the embodiment illustrated in FIG. 1, the potentiometer 12 is inserted into the adapter aperture 22 of the adapter 20 in a direction of arrow 48, that is, through the front surface 18 of the adapter 20 which has been positioned within the faceplate of the hearing aid. The potentiometer 12 is inserted until the potentiometer annular shoulder 42 engages the inner annular shoulder 24, the engagement of the potentiometer annular shoulder 42 and the inner annular shoulder 24 having been selected such that the knob 34 is disposed above the front surface 18.

Although the present invention has been described with reference to preferred embodiments, persons having ordinary skill in the art will recognize that changes may be made in form and detail without departing from the spirit and scope of the invention.

What is claimed is:

1. A potentiometer retention mechanism for mounting a potentiometer on the faceplate of a hearing aid, the potentiometer including a rotatable knob attached to a housing, the housing including a plurality of potentiometer leads projecting from a back surface of the housing, the potentiometer leads being conductive, the mechanism comprising:

an adapter for receiving the potentiometer, the adapter having engaging means for mechanically engaging the faceplate such that the adapter is secured within the faceplate;

a plurality of angled leads attached to the adapter and connected to the hearing aid, whereby the potentiometer leads press against the angled leads to secure the housing within the adapter and to conductively connect the angled leads to the potentiometer leads.

2. The mechanism of claim 1 and further including means for positioning the potentiometer a selected distance within the adapter.

3. The mechanism of claim 2 wherein the means for positioning the potentiometer includes a first stop integral to the housing and extending outwardly from the housing.

4. The mechanism of claim 3 wherein the adapter includes a second stop and the first stop is positioned such that the knob of the potentiometer extends beyond a front surface of the adapter.

5. A method of mounting a potentiometer on a faceplate of a hearing aid, the method comprising the steps of:

providing a potentiometer having a rotatable knob attached to a housing and a plurality of potentiometer leads projecting from a back surface of the housing, the potentiometer leads being conductive;

providing an adapter having means for mechanically engaging a faceplate of the hearing aid such that the adapter is secured within the faceplate, the adapter having a plurality of angled leads, the angled leads being conductive; and axially inserting the potentiometer into the adapter such that the potentiometer leads press against the angled leads to secure the housing within the adapter and to conductively connect the angled leads and the potentiometer leads.

6. The method of claim 5 wherein the adapter includes a first stop and the potentiometer includes a second stop wherein the potentiometer is inserted into the adapter until the second stop engages the first stop such that a knob of the potentiometer extends beyond a front surface of the adapter.

* * * * *